US011187085B2

(12) United States Patent
Zemitis et al.

(10) Patent No.: US 11,187,085 B2
(45) **Date of Patent: *Nov. 30, 2021**

(54) TURBINE BUCKET WITH A COOLING CIRCUIT HAVING AN ASYMMETRIC ROOT TURN

(71) Applicant: General Electric Company, Schenectady, NY (US)

(72) Inventors: William Scott Zemitis, Simpsonville, SC (US); Luke C. Sponseller, Greer, SC (US); Michael Gordon Sherman, Taylors, SC (US)

(73) Assignee: General Electric Company, Schenectady, NY (US)

( * ) Notice: Subject to any disclaimer, the term of this patent is extended or adjusted under 35 U.S.C. 154(b) by 6 days.

This patent is subject to a terminal disclaimer.

(21) Appl. No.: 16/713,376

(22) Filed: Dec. 13, 2019

(65) Prior Publication Data

US 2020/0116030 A1 Apr. 16, 2020

Related U.S. Application Data

(63) Continuation-in-part of application No. 15/816,240, filed on Nov. 17, 2017, now Pat. No. 10,544,686.

(51) Int. Cl.
*F01D 5/18* (2006.01)

(52) U.S. Cl.
CPC ..... *F01D 5/185* (2013.01)

(58) Field of Classification Search
CPC ..... F05D 2240/81; F05D 2260/221; F05D 2260/941
See application file for complete search history.

(56) References Cited

U.S. PATENT DOCUMENTS

| | | | | |
|---|---|---|---|---|
| 4,302,153 | A * | 11/1981 | Tubbs | F01D 5/18 416/96 R |
| 5,873,695 | A | 2/1999 | Takeishi et al. | |
| 8,535,004 | B2 * | 9/2013 | Campbell | F01D 5/187 416/97 R |
| 8,562,286 | B2 | 10/2013 | Gleiner et al. | |
| 8,974,182 | B2 | 3/2015 | Boyer et al. | |
| 2004/0094287 | A1 | 5/2004 | Wang | |
| 2007/0189898 | A1 | 8/2007 | Hooper et al. | |
| 2013/0209253 | A1 | 8/2013 | Zemitis et al. | |
| 2015/0110639 | A1 | 4/2015 | Herzlinger et al. | |
| 2016/0319680 | A1 | 11/2016 | Roman-Morales et al. | |
| 2017/0002664 | A1 | 1/2017 | McKenzie et al. | |

* cited by examiner

*Primary Examiner* — Woody A Lee, Jr.
*Assistant Examiner* — Maxime M Adjagbe
(74) *Attorney, Agent, or Firm* — Dority & Manning, P.A.

(57) ABSTRACT

A turbine bucket may include a platform, an airfoil extending from the platform at an intersection thereof, and a cooling circuit extending within the platform and the airfoil. The cooling circuit may include a root turn with an asymmetric shape to reduce stress concentrations therein. The asymmetric shape of the root turn may be asymmetrical along a path between a pressure side of the airfoil and a suction side of the airfoil. The asymmetric shape of the root turn may be asymmetrical within a plane defined by a radial direction and a circumferential direction.

18 Claims, 6 Drawing Sheets

TURBINE BUCKET WITH A COOLING CIRCUIT HAVING AN ASYMMETRIC ROOT TURN

RELATED APPLICATIONS

This application is a continuation-in-part of and claims priority to U.S. patent application Ser. No. 15/816,240 filed on Nov. 17, 2017, which is incorporated herein by reference in its entirety for all purposes.

TECHNICAL FIELD

The present application and the resultant patent relate generally to gas turbine engines and, more particularly, relate to a gas turbine engine with a turbine bucket having an airfoil with a cooling circuit having an asymmetric root turn to promote stress reduction.

BACKGROUND

Known gas turbine engines generally include rows of circumferentially spaced nozzles and buckets. A turbine bucket generally includes an airfoil having a pressure side and a suction side and extending radially upward from a platform. A hollow shank portion may extend radially downward from the platform and may include a dovetail and the like to secure the turbine bucket to a turbine wheel. The platform generally defines an inner boundary for the hot combustion gases flowing through a gas path. As such, the intersection of the platform and the airfoil may be an area of high stress concentration due to the hot combustion gases, the mechanical loading thereon, and other causes.

More specifically, there is often a large amount of thermally or otherwise induced strain at the intersection of an airfoil and a platform. This induced strain may be due to the temperature differentials between the airfoil and the platform and between the pressure side and the suction side as well as due to rotational velocity loading. The induced strain may combine with geometric discontinuities in the region, thereby creating areas of very high stress that may limit overall component lifetime. To date, these issues have been addressed by attempting to keep geometric discontinuities such as root turns, tip turns, internal ribs, and the like, away from the intersection. Further, attempts have been made to control the temperature about the intersection. Temperature control, however, generally requires additional cooling flows at the expense of overall engine efficiency. These known cooling arrangements thus may be difficult and expensive to manufacture and/or may require the use of an excessive amount of air or other types of parasitic cooling flows.

SUMMARY OF THE DISCLOSURE

The present application and the resultant patent thus provide a turbine bucket. The turbine bucket may include a platform, an airfoil extending from the platform at an intersection thereof, and a cooling circuit extending within the platform and the airfoil. The cooling circuit may include a root turn with an asymmetric shape to reduce stress concentrations in the intersection.

The present application and the resultant patent further provide a turbine bucket. The turbine bucket may include a platform, an airfoil extending from the platform at an intersection thereof, and a serpentine cooling circuit extending within the platform and the airfoil. The serpentine cooling circuit may include a number of root turns with an asymmetric shape having a built up area and a reduced area to reduce stress concentrations in the intersection.

These and other features and improvement of the present application and the resultant patent will become apparent to one of ordinary skill in the art upon review of the following detailed description when taken in conjunction with the several drawings and the appended claims.

DETAILED DESCRIPTION

Figure 1:
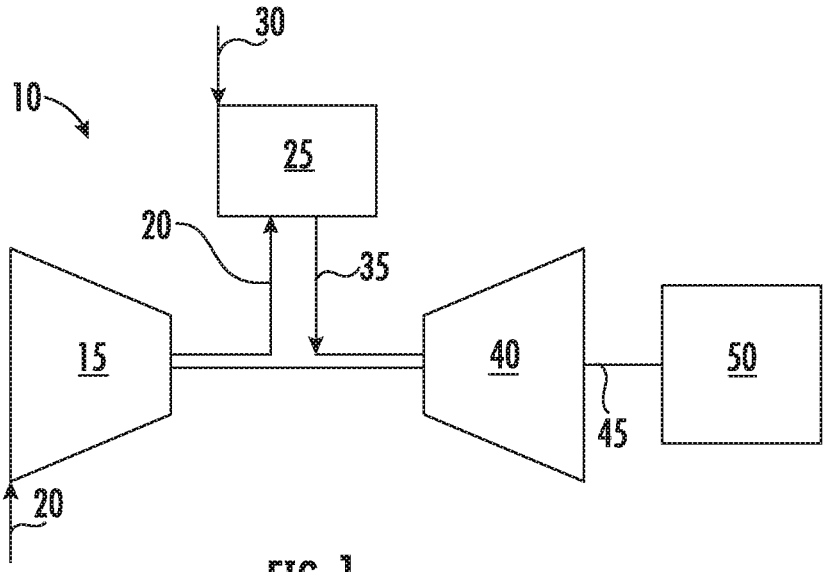
FIG. 1 is a schematic diagram of a gas turbine engine with a compressor, a combustor, a turbine, and a load.

Referring now to the drawings, in which like numerals refer to like elements throughout the several views, FIG. 1 shows a schematic view of gas turbine engine 10 as may be used herein. The gas turbine engine 10 may include a compressor 15. The compressor 15 compresses an incoming flow of air 20. The compressor 15 delivers the compressed flow of air 20 to a combustor 25. The combustor 25 mixes the compressed flow of air 20 with a pressurized flow of fuel 30 and ignites the mixture to create a flow of combustion gases 35. Although only a single combustor 25 is shown, the gas turbine engine 10 may include any number of combustors 25. The flow of combustion gases 35 is in turn delivered to a turbine 40. The flow of combustion gases 35 drives the turbine 40 to produce mechanical work. The mechanical work produced in the turbine 40 drives, via a shaft 45, the compressor 15 and an external load 50, such as an electrical generator and the like.

The gas turbine engine 10 may use natural gas, various types of syngas, liquid fuels, and/or other types of fuels and blends thereof. The gas turbine engine 10 may be any one of a number of different gas turbine engines offered by General Electric Company of Schenectady, N.Y., including, but not limited to, those such as a 7 or a 9 series heavy-duty gas turbine engine and the like. The gas turbine engine 10 may have different configurations and may use other types of components. Other types of gas turbine engines also may be used herein. Multiple gas turbine engines, other types of turbines, and other types of power generation equipment also may be used herein together.

Figure 2:
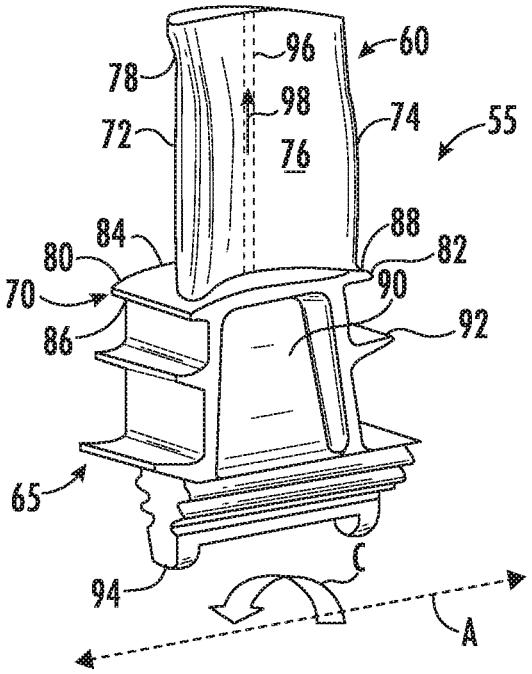
FIG. 2 is a perspective view of a turbine bucket.

FIG. 2 shows an example of a turbine bucket 55 that may be used with the turbine 40. Generally described, the turbine bucket 55 includes an airfoil 60, a shank portion 65, and a platform 70 disposed between the airfoil 60 and the shank portion 65. The airfoil 60 generally extends radially outward from the platform 70 and includes a leading edge 72 and a trailing edge 74. The airfoil 60 also may include a concave wall defining a pressure side 76 and a convex wall defining a suction side 78. The platform 70 may be substantially horizontal and planar. Likewise, the platform 70 may include a top surface 80, a pressure face 82, a suction face 84, a forward face 86, and an aft face 88. The top surface 80 of the platform 70 may be exposed to the flow of the hot combustion gases 35. The shank portion 65 may extend radially inward from the platform 70 such that the platform 70 generally defines an interface between the airfoil 60 and the shank portion 65. The shank portion 65 may include a shank cavity 90 therein. The shank portion 65 also may include one or more angel wings 92 and a root structure 94, such as a dovetail and the like. The root structure 94 may be configured to secure the turbine bucket 55 to a rotor disk. Other components and other configurations may be used herein.

The turbine bucket 55 may include one or more cooling circuits 96 extending therethrough for flowing a cooling medium 98, such as air from the compressor 15 or from another source. The cooling circuits 96 and the cooling medium 98 may circulate at least through portions of the airfoil 60, the shank portion 65, and the platform 70 in any order, direction, or route to form a cooling medium flow path. Many different types of cooling circuits and cooling mediums may be used herein. Other components and other configurations also may be used herein.

Figure 3:
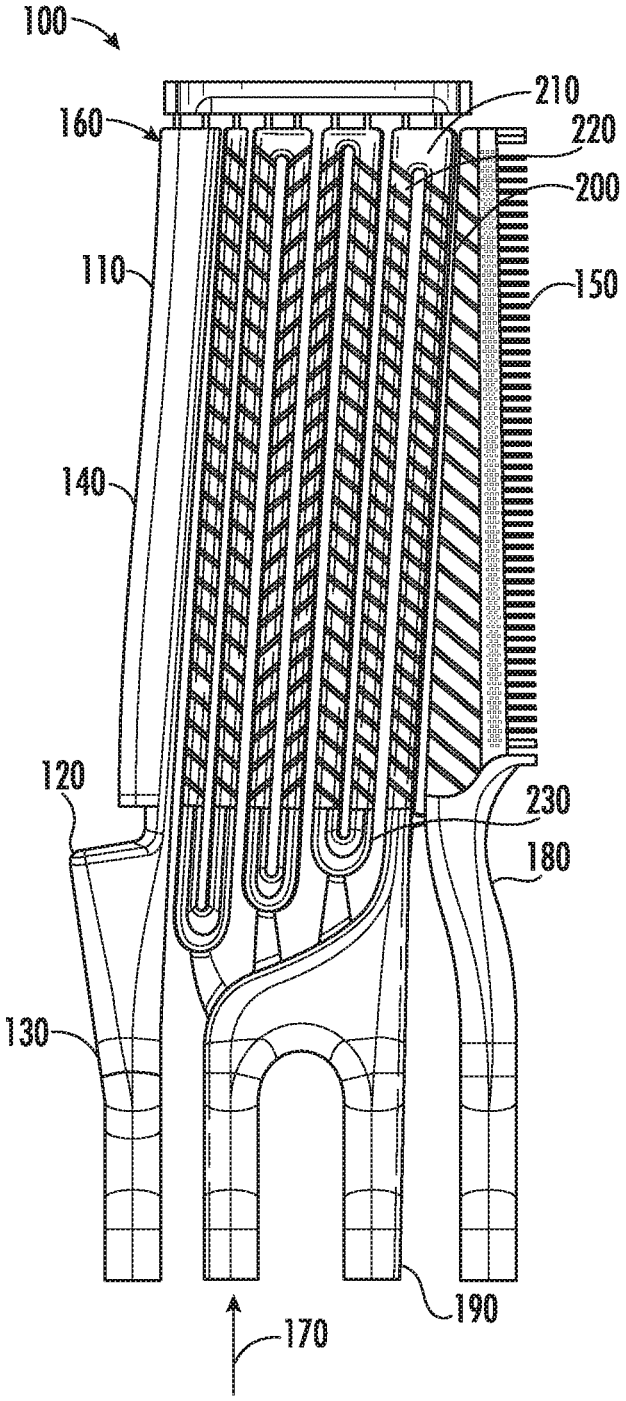
FIG. 3 is a side plan view of a core body of a turbine bucket, as described herein.

FIG. 3 shows an example of a portion of a turbine bucket 100, according to one embodiment described herein. In particular, the portion of the turbine bucket shown in FIG. 3 includes one or more internal surfaces of the turbine bucket, such as may be provided as an insert separately formed from the airfoil, e.g., airfoil 60 illustrated in FIG. 2, and then inserted into the airfoil 60 to provide the cooling circuit 96. In some embodiments, the surfaces illustrated in FIG. 3 may comprise an insert mold about which components of a turbine bucket may be cast, such that the surfaces illustrated in FIG. 3 may thus comprise outer boundary surfaces defining negative spaces (e.g., cooling circuits 96) within the turbine bucket 100.

The turbine bucket 100 may include an airfoil 110, a platform 120, and a shank portion 130. Similar to that described above, the airfoil 110 extends radially outward from the platform 120 and includes a leading edge 140 and a trailing edge 150. Within the turbine bucket 100, there may be a number of core cavities 160. The core cavities 160 may supply a cooling medium 170 to the components thereof to cool the overall turbine bucket 100. The cooling medium 170 may be air, steam, and the like from any source. The core cavities 160 may define one or more serpentine cooling circuits 180 extending therethrough. Specifically, each serpentine cooling circuit 180 may extend from a cooling input 190 about the shank portion 130 towards the platform 120 and the airfoil 110. The serpentine cooling circuit 180 may extend along a first channel 200 in a first direction through the airfoil 110, reverse direction through a tip turn 210, extend along a second channel 220 in a second direction, again reverse direction through a root turn 230, extend back through a further first channel 200 in the first direction, and so forth in any number of repeats. Other components and other configurations may be used.

Figure 4:
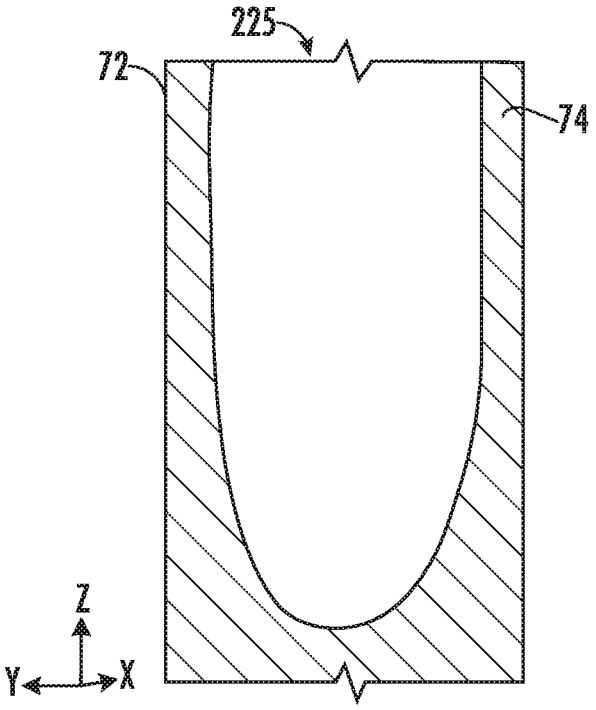
FIG. 4 PRIOR ART
FIG. 4 is an expanded view of a symmetrical root turn.
Figure 5:
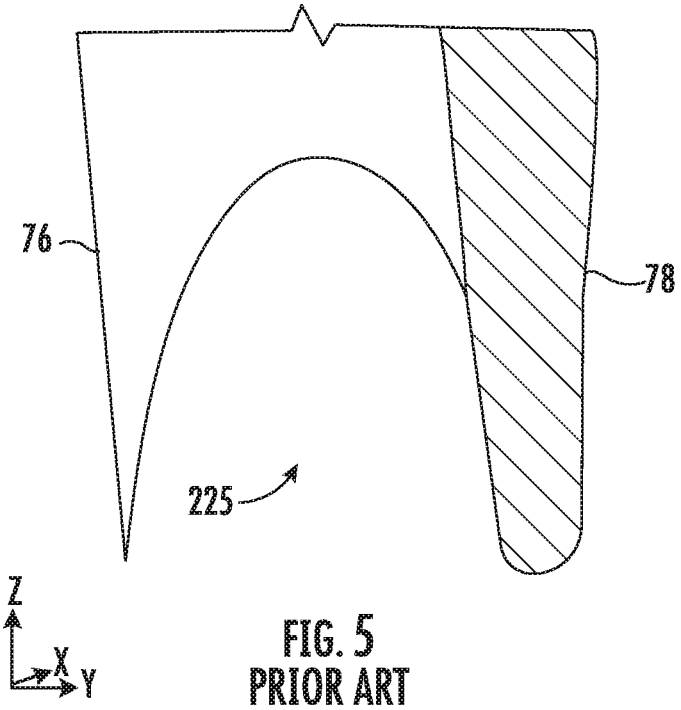
FIG. 5 PRIOR ART
FIG. 5 is a further expanded view of the symmetrical root turn of FIG. 4.

Conventional root turns generally utilized a symmetric turn with round blends and fillets. FIGS. 4 and 5 show a typical, largely symmetric root turn 225. Specifically, FIG. 4 shows the root turn 225 from the leading edge 72 to the trailing edge 74. FIG. 5 shows the root turn 225 from the pressure side 76 to the suction side 78.

Figure 6:
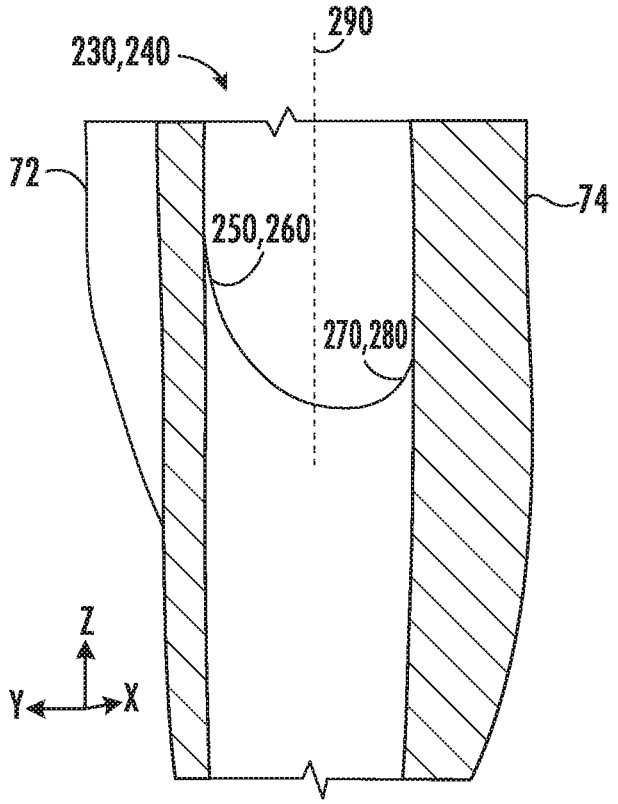
FIG. 6 is an expanded view of an asymmetrical root turn, as described herein.
Figure 7:
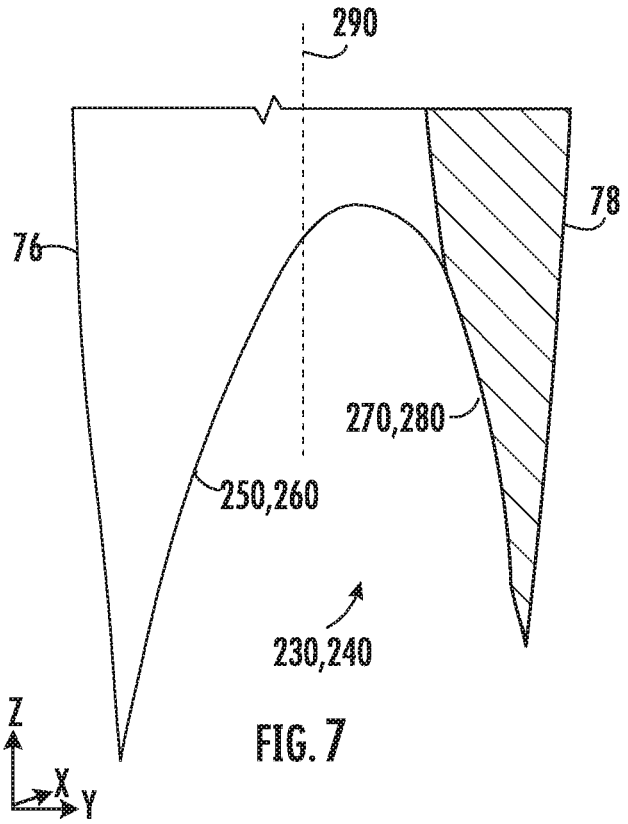
FIG. 7 is a further expanded view of the asymmetrical root turn of FIG. 6.

FIGS. 6 and 7 show an expanded view of a root turn 230 described herein. Specifically, the root turn 230 may include an asymmetric shape 240. The asymmetric shape 240 may minimize the curvature of the turn in higher stress regions and increase curvature in regions of lower stress to reduce overall stress concentrations therein. Specifically, FIG. 6 shows the root turn 230 from the leading edge 72 to the trailing edge 74. FIG. 7 shows the root turn 230 from the pressure side 76 to the suction side 78.

The asymmetric shape 240 may be determined by numerical modeling and field experience. Generally described, a first side 250 of the asymmetric turn 240 may now have a built up area 260 as compared to a second side 270 which may have a recessed area 280 with less material. The first side 250 or the second side 270 may extend beyond a center line 290 at an off center angle for any distance. The nature of the asymmetric shape 240 may vary according to the overall geometry of the turbine bucket 100. For example, in some embodiments, the first portion or side 250 having the built-up area 260 may extend from the centerline 290 towards the pressure side wall 76 of the airfoil, and the second portion or side 270 having the recessed area 280 may extend from the centerline 290 towards the suction side wall 78 of the airfoil, as illustrated in FIG. 7. In other embodiments, the first portion or side 250 having the built-up area 260 may extend from the centerline 290 towards the suction side wall 78 of the airfoil, and the second portion or side 270 having the recessed area 280 may extend from the centerline 290 towards the pressure side wall 76 of the airfoil.

The definition of curvature is: $k=1/R$. When one increases curvature (k), one is reducing the local radius (R). Here, the asymmetric shape 240 increases the local radius in high stress regions (decreasing curvature) and reduces the local radius in lower stress regions (increasing curvature). Although the changes are shown from the side of the blade, the curvature may be altered in any dimension. Specifically, while curvature may be reduced in one dominant plane, it further may be reduced by adjustments in the other plane as well.

The ideal ratio of the radii on the sides of the turn may be determined by numerical analysis and may be dependent on the unique materials, temperatures, rotational velocity loads, and passage flow area requirements involved. The maximum useful stress reduction may lie at some point between the two designs. Overall stress concentrations may be reduced by twenty percent or more to provide a lifetime improvement of two to three times or more. Such an improved useful lifetime is significant in terms of cost and downtime. Other components and other configurations may be used herein.

The use of the asymmetric shape 240 in the root turn 230 thus reduces the stress concentrations therein, while maintaining an adequate cooling flow therethrough. Reducing stresses at the root turn 230 provides increased overall lifetime with reduced maintenance and reduced costs. Further, excessive amounts of the cooling medium 170 may not be required herein. The overall impact of thermal expansion and other causes of stress on the turbine bucket 100 thus may be reduced.

Figure 8:
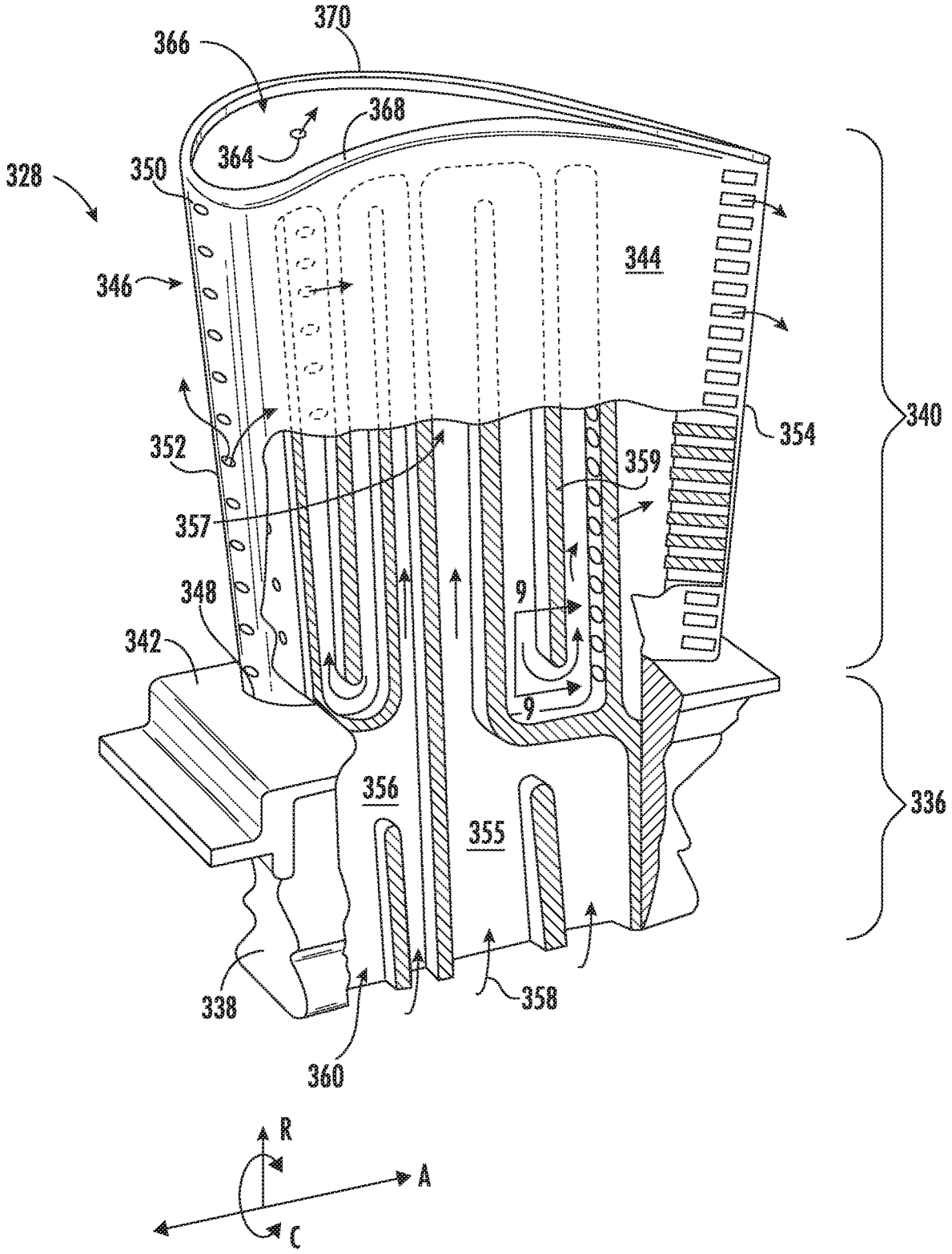
FIG. 8 is a partially cut away perspective view of an exemplary rotor blade, as incorporates various embodiments of the present disclosure.

FIG. 8 provides a perspective views of an exemplary rotor blade 328, according to one or more additional embodiments of the present disclosure. As shown in FIG. 8, the rotor blade 328 generally includes a mounting or shank portion 336 having a mounting body 338 and an airfoil 340 that extends substantially radially outwardly from a substantially planar platform 342. The platform 342 generally serves as the radially inward boundary for the hot gases of combustion 35 flowing through the hot gas path of the turbine section 40

(FIG. 1). As shown in FIG. 8, the mounting body 338 of the mounting or shank portion 336 may extend radially inwardly from the platform 342 and may include a root structure, such as a dovetail, configured to interconnect or secure the rotor blade 328 to a rotor disk (not shown).

The airfoil 340 includes a pressure side wall 344 and an opposing suction side wall 346. The pressure side wall 344 and the suction side wall 346 extend substantially radially outwardly from the platform 342 in span from a root 348 of the airfoil 340, which may be defined at an intersection between the airfoil 340 and the platform 342, to a tip 350 of the airfoil 340. The airfoil 340 extends between a leading edge 352 of the airfoil 340 and a trailing edge 354 downstream of the leading edge 352. The pressure side wall 344 generally comprises an aerodynamic, concave external surface of the airfoil 340. Similarly, the suction side wall 346 may generally define an aerodynamic, convex external surface of the airfoil 340. The tip 350 is disposed radially opposite the root 348. As such, the tip 350 may generally define the radially outermost portion of the rotor blade 328 and, thus, may be configured to be positioned adjacent to a stationary shroud or seal (not shown) of the gas turbine engine 10. The tip 350 may include a tip cavity 366.

As shown in FIG. 8, the rotor blade 328 may be at least partially hollow, e.g., a plurality of cooling passages 356 (shown partially in dashed lines in FIG. 8) may be circumscribed within the airfoil 40 for routing a coolant 358 through the airfoil 340 between the pressure side wall 344 and the suction side wall 346, thus providing convective cooling thereto. The coolant 358 may include a portion of the compressed air from the compressor section 15 (FIG. 1) and/or steam or any other suitable gas or other fluid for cooling the airfoil 340. One or more cooling passage inlets 360 are disposed along the rotor blade 328. In some embodiments, one or more cooling passage inlets 360 are formed within, along or by the mounting body 338. The cooling passage inlets 360 are in fluid communication with at least one corresponding cooling passage 356. A plurality of coolant outlets 364 may be in fluid communication with the tip cavity 366. Each cooling passage 356 is in fluid communication with at least one of the coolant outlets 364. In some embodiments, the tip cavity 366 may be at least partially surrounded by a pressure side tip rail 368 and a suction side tip rail 370.

As may be seen in FIG. 8, the cooling passages 356 extend within each of the shank portion 336 and the airfoil portion 340. For example, the cooling passages 356 may extend between the shank portion 336 and the airfoil portion 340, e.g., from the shank portion 336 to the airfoil portion 340, such as from the one or more cooling passage inlets 360 in the shank portion 336 to the at least one coolant outlet 364 in the tip 350 of the airfoil portion 340. As such, each cooling passage 356 may include a first or radially inner portion 355 within the shank portion 356 and a second or radially outer portion 357 within the airfoil portion 340 of the rotor blade 328.

As best seen in FIGS. 2 and 8, the turbine engine 10 may define an axial direction A and a circumferential direction C, which extends around the axial direction A. As may be seen in FIGS. 8 and 9, the turbine engine 10 may also define a radial direction R perpendicular to the axial direction A.

Referring again to FIGS. 6 and 7, portions of internal surfaces of the turbine blade are illustrated, e.g., portions of surfaces which may define boundaries of negative space, in particular cooling passages 356 or cooling circuits 96, 180, within the turbine blade 328, 55, or 100, respectively. As shown in FIGS. 6 and 7, the turbine engine 10 may define a first direction X which is aligned with the axial direction A, a second direction Z which is aligned with the radial direction R, and a third direction Y which is mutually perpendicular with both the first direction X and the second direction Z. Thus, as may be seen, e.g., in FIG. 7, the asymmetric root turn 230 may be asymmetrical in a direction, or along a path, between the pressure side 76 of the airfoil 60 and the suction side 78 of the airfoil 60. For example, the asymmetric root turn 230 may be asymmetrical in a plane defined by the second direction Z (e.g., the radial direction R) and the third direction Y, which is perpendicular to both the first direction X (e.g., axial direction A) and the second direction Z. Further, as may also be seen in FIG. 7, the asymmetric root turn 230 may also be asymmetrical in a plane defined by the first direction X and the second direction Z, which plane may also be referred to as an axial-radial plane. In some embodiments, the asymmetric root turn 230 may be asymmetrical in a direction, or along a path, between the leading edge 72 of the airfoil 60 and the trailing edge 74 of the airfoil 60, as shown in FIG. 6.

Figure 9:
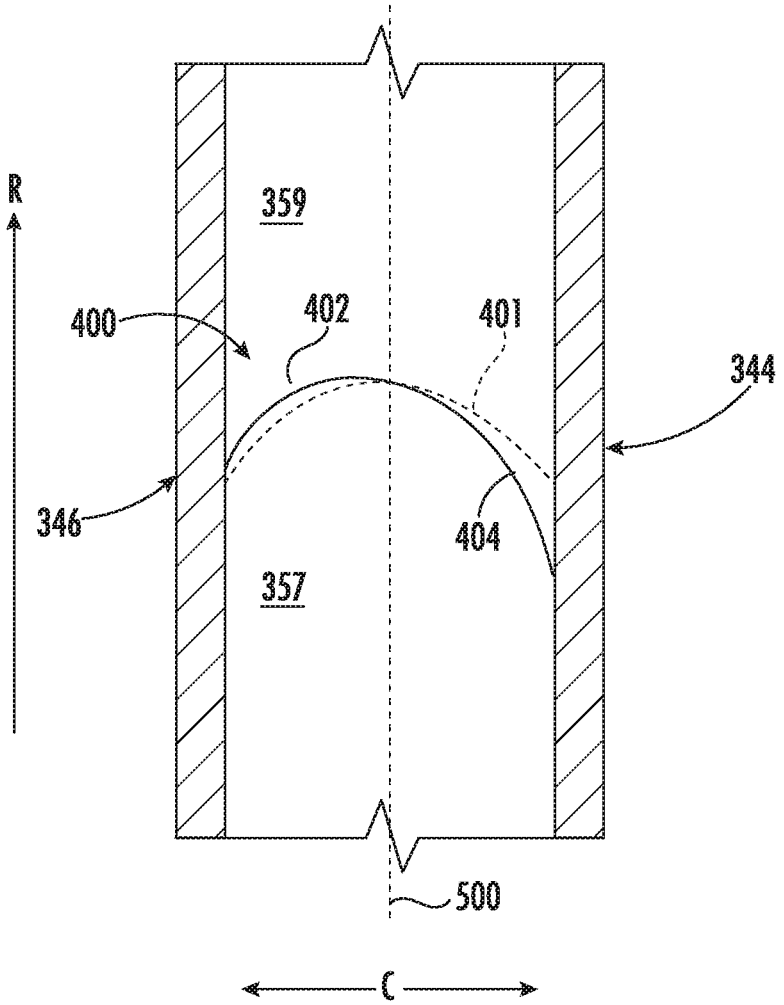
FIG. 9 is a section view of a portion of the exemplary rotor blade of FIG. 8.

Turning now to FIG. 9, an enlarged section view of a portion of the rotor blade 328 is provided. In particular, the blade 328 of FIG. 8 is sectioned along line 9-9 in FIG. 8, and the section view of FIG. 9 is looking in the direction indicated by the arrows on line 9-9 in FIG. 8, e.g., looking aftward (downstream) towards the trailing edge 354 of the rotor blade 328. FIG. 9 illustrates a radially outer portion 400 of an exemplary root turn 230 of a cooling passage 356, where the exemplary root turn 230 is closer to the trailing edge 354 than to the leading edge 352, e.g., the root turn 230 is positioned proximate to the trailing edge 354 of the airfoil 340 and distal from the leading edge 352 of the airfoil 340. For example, the root turn 230 having an asymmetrical shape may be positioned in a trailing portion of the airfoil 340, which is downstream of an axial midpoint of the airfoil 340.

As may be seen in FIG. 9, a radially outer surface 359, which forms a boundary of the cooling passage 356 at the root turn, may be asymmetrical about a centerline 500 of the airfoil 340. In particular, the centerline 500 may extend through a circumferential midpoint (e.g., a middle of the airfoil 340 along the circumferential direction C) of the airfoil 340 such that the centerline 500 is equidistant from the pressure side wall 344 and the suction side wall 346. In particular, the asymmetrical shape of the surface 359 at the radially outer portion 400 of the root turn 230 may include a first portion 402 (which extends between the suction side wall 346 and the centerline 500) and a second portion 404 directly adjoined to the first portion 402 at the centerline 500, the second portion 404 extending from the centerline 500 towards the pressure side wall 344. A symmetrical shape 401 of a root turn is illustrated in dashed lines in FIG. 9. By comparison to the symmetrical shape 401 in FIG. 9, it may be seen that the first portion 402 of the radially outer portion 400 of the root turn 230 comprises a reduced amount of material relative to the symmetrical shape 401, whereas the second portion 404 of the radially outer portion 400 of the root turn 230 comprises an increased amount of material relative to the symmetrical shape 401.

Thus, as may be seen for example in FIG. 9, the asymmetrical shape of the root turn 230 may be asymmetrical in a radial-circumferential plane defined by the circumferential direction C and the radial direction R. The asymmetrical shape of the root turn 230 may also be asymmetrical in a direction between the pressure side wall 344 and the suction side wall 346, such as a direction perpendicular to at least one of the pressure side wall 344 and the suction side wall 346, such as perpendicular to a camber line of the airfoil 340 at the root turn 230. Further, the asymmetrical shape of the root turn 230 may be asymmetrical with respect to the centerline 500 of the airfoil 340, where the centerline 500 extends along the radial direction R through a circumferential midpoint of the airfoil 340 at the root turn 230.

It should be apparent that the foregoing relates only to certain embodiments of the present application and the resultant patent. Numerous changes and modifications may be made herein by one of ordinary skill in the art without departing from the general spirit and scope of the disclosure as defined by the following claims and the equivalents thereof.

We claim:

1. A turbine bucket, comprising:

a platform;

an airfoil extending from the platform at an intersection thereof, the airfoil comprising a pressure side wall and a section side wall; and a cooling circuit extending within the platform and the airfoil;

wherein the cooling circuit comprises a root turn with an asymmetric shape to reduce stress concentrations therein, and wherein the asymmetric shape of the root turn is asymmetrical along a path extending from the pressure side wall of the airfoil to the suction side wall of the airfoil.

2. The turbine bucket of claim 1, wherein the path between the pressure side wall of the airfoil and the suction side wall of the airfoil is perpendicular to at least one of the pressure side wall of the airfoil and the suction side wall of the airfoil.

3. The turbine bucket of claim 1, wherein the path between the pressure side wall of the airfoil and the suction side wall of the airfoil is perpendicular to a camber line of the airfoil at the root turn.

4. The turbine bucket of claim 1, wherein the cooling circuit comprises a serpentine cooling circuit.

5. The turbine bucket of claim 1, wherein the root turn with the asymmetric shape comprises a first portion and a second portion; and wherein the first portion comprises a recessed area having a decreased amount of material relative to a symmetric shape.

6. The turbine bucket of claim 5, wherein the second portion comprises a built up area having an increased amount of material relative to the symmetric shape.

7. The turbine bucket of claim 5, wherein the turbine bucket defines a centerline extending along a radial direction through a circumferential midpoint of the airfoil; and wherein the first portion extends from the centerline towards the suction side wall of the airfoil, and the second portion extends from the centerline towards the pressure side wall of the airfoil.

8. The turbine bucket of claim 1, wherein the root turn with the asymmetric shape is positioned proximate to a trailing edge of the airfoil and distal from a leading edge of the airfoil.

9. The turbine bucket of claim 1, wherein the asymmetric shape of the root turn is defined in a radially outer portion of the root turn.

10. The turbine bucket of claim 1, further comprising a plurality of root turns with an asymmetric shape.

11. The turbine bucket of claim 1, wherein the root turn with an asymmetric shape extends from a first channel to a second channel.

12. The turbine bucket of claim 11, wherein the first channel and the second channel extend to a tip turn.

13. A gas turbine engine defining an axial direction, a circumferential direction extending around the axial direction, and a radial direction perpendicular to the axial direction, the gas turbine engine comprising:

a compressor;

a combustor downstream of the compressor; and a turbine downstream of the combustor, the turbine comprising a rotor blade mounted to a rotor disk, the rotor blade comprising:

a platform;

an airfoil extending outward along the radial direction from the platform at an intersection thereof; and a cooling circuit extending within the platform and the airfoil;

wherein the cooling circuit comprises a root turn with an asymmetric shape, and wherein the asymmetric shape of the root turn is asymmetrical within a plane defined by the radial direction and the circumferential direction.

14. The gas turbine engine of claim 13, wherein the root turn with an asymmetric shape comprises a first portion and a second portion; and wherein the first portion comprises a recessed area having a decreased amount of material relative to a symmetric shape.

15. The gas turbine engine of claim 14, wherein the second portion comprises a built up area having an increased amount of material relative to a symmetric shape.

16. The gas turbine engine of claim 14, wherein the rotor blade defines a centerline extending along the radial direction through a circumferential midpoint of the airfoil; and wherein the first portion extends from the centerline towards a suction side wall of the airfoil, and the second portion extends from the centerline towards a pressure side wall of the airfoil.

17. The gas turbine engine of claim 13, wherein the asymmetric shape of the root turn is defined in a radially outer portion of the root turn.

18. The gas turbine engine of claim 13, wherein the root turn with the asymmetric shape is positioned proximate to a trailing edge of the airfoil and distal from a leading edge of the airfoil.

* * * * *